US008807733B2

(12) United States Patent
Fujisawa et al.

(10) Patent No.: US 8,807,733 B2
(45) Date of Patent: Aug. 19, 2014

(54) ELECTROMAGNETIC IRRADIATION DEVICE AND IMAGE FORMING APPARATUS

(75) Inventors: Kazutoshi Fujisawa, Okaya (JP); Yoshimitsu Hayashi, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 13/359,875

(22) Filed: Jan. 27, 2012

(65) Prior Publication Data

US 2012/0194623 A1 Aug. 2, 2012

(30) Foreign Application Priority Data

Feb. 1, 2011 (JP) ..... 2011-019527

(51) Int. Cl.
*B41J 2/01* (2006.01)
*B41J 11/00* (2006.01)
*B41M 7/00* (2006.01)

(52) U.S. Cl.
CPC ..... *B41M 7/0081* (2013.01); *B41J 11/002* (2013.01)
USPC ..... 347/102

(58) Field of Classification Search
USPC ..... 347/102
See application file for complete search history.

(56) References Cited

U.S. PATENT DOCUMENTS 6,102,538 A * 8/2000 Ochi et al. ..... 347/103
7,152,970 B2 * 12/2006 Hasebe et al. ..... 347/102
2005/0200676 A1 * 9/2005 Kadomatsu et al. ..... 347/102
2006/0119686 A1 * 6/2006 Odell ..... 347/102
2006/0230969 A1 * 10/2006 Vosahlo ..... 101/488
2007/0040885 A1 * 2/2007 Kusunoki ..... 347/102
2007/0139504 A1 6/2007 Siegel
2008/0252909 A1 10/2008 Honguh et al.
2009/0225143 A1 9/2009 Fukui
2009/0280302 A1 11/2009 Fukumoto et al.
2010/0149295 A1 * 6/2010 Kulpa et al. ..... 347/102
2011/0001782 A1 * 1/2011 Jang et al. ..... 347/102

FOREIGN PATENT DOCUMENTS

DE 102005031572 3/2006
JP 2006-142613 6/2006
JP 2009-057548 3/2009
WO 2004-002746 1/2004
WO 2005-068510 7/2005
WO 2010-105365 9/2010

OTHER PUBLICATIONS

Extended European Search Report dated Jun. 18, 2012 for European Patent Application No. 12153447.3.

* cited by examiner

*Primary Examiner* — Julian Huffman
*Assistant Examiner* — Sharon A Polk
(74) *Attorney, Agent, or Firm* — Workman Nydegger

(57) ABSTRACT

An electromagnetic irradiation device is provided. The electromagnetic irradiation device includes an irradiator which irradiates droplets that are attached to a recording medium with an electromagnetic wave, an irradiation control unit which causes the irradiator to periodically irradiate the attached droplets with the electromagnetic, and a frequency setting unit which sets a frequency of an irradiation period which is a period during which the irradiator is caused to emit the electromagnetic wave. The period may be set to be equal to or greater than 5 Hz, and less than 1000 Hz.

14 Claims, 4 Drawing Sheets

| | GLOSS MODE | | SEMI-GLOSS MODE | | MATT MODE | |
|---|---|---|---|---|---|---|
| USING CL | USING | NOT USING | USING | NOT USING | USING | NOT USING |
| W | 0Hz | 0Hz | 0Hz | 0Hz | 0Hz | 0Hz |
| C | 0Hz | 200Hz | 0Hz | 10Hz | 0Hz | 0Hz |
| M | 0Hz | 200Hz | 0Hz | 10Hz | 0Hz | 0Hz |
| Y | 0Hz | 200Hz | 0Hz | 10Hz | 0Hz | 0Hz |
| K | 0Hz | 200Hz | 0Hz | 10Hz | 0Hz | 0Hz |
| CL | 200Hz | | 10Hz | | 0Hz | |

ELECTROMAGNETIC IRRADIATION DEVICE AND IMAGE FORMING APPARATUS

This application claims priority to Japanese Application No. 2011-019527 file Feb. 1, 2011, which application is incorporated by reference in its entirety.

BACKGROUND

1. Technical Field

Embodiments of the present invention relate to an electromagnetic irradiation device which includes an irradiator that irradiates droplets attached to a recording medium with an electromagnetic wave, and to an image forming apparatus.

2. Related Art

A recording device which controls a flash light source so as to irradiate photo-curable ink with flash light at least once has been proposed (refer to JP-A-2006-142613). Since the ink is irradiated with flash light at least once, it is possible to reliably harden the ink.

One of the problems in JP-A-2006-142613, however, is that even if it is possible to reliably harden the ink, it is difficult to realize an ink droplet with a high surface gloss.

SUMMARY

Embodiments of the invention advantageously provide a technology that realizes droplets with a high surface gloss.

According to an embodiment of the invention, an electromagnetic irradiation device is provided. The electromagnetic irradiation device includes: an irradiator which irradiates droplets which are attached to a recording medium with an electromagnetic wave; an irradiation control unit which causes the irradiator to periodically irradiate the droplets with the electromagnetic wave; and a frequency setting unit which sets a frequency of an irradiation period. The irradiation period is a period during which the irradiator emits the electromagnetic wave and is equal to or greater than 5 Hz and less than 1000 Hz. In this manner, it is possible to realize a droplet with a high surface gloss.

The surface of the droplet is hardened with a bias during the period that the electromagnetic wave is emitted. Since the electromagnetic wave is attenuated while proceeding toward the depth direction or in the depth direction of the droplet, the energy of the electromagnetic wave necessary for hardening the droplet can be applied with a bias to the surface. Accordingly, it is possible to accelerate the hardening of the surface of the droplet during an emission of the electromagnetic wave.

On the other hand, since the surface of the droplet is exposed to oxygen, the hardening of the surface of the droplet is oxygen inhibited. In other words, the presence of oxygen may inhibit or Particularly, during a time when the electromagnetic wave is not emitted, the inside of the droplet of which the hardening is not easily suppressed due to the oxygen inhibition is hardened with a bias. In other words, the inside of the droplet may not subject to the oxygen inhibition (unlike the surface of the droplet) and, as a result, the hardening of the inside of the droplet is not easily suppressed. However, there may be instances when the inside of the droplet is subject to oxygen inhibition.

It is possible to make the hardening of the droplet on the surface and inside thereof proceed in a balanced manner by setting a period in which an electromagnetic wave is irradiated and a period in which an electromagnetic wave is not irradiated. In other words, the hardening of the droplet can be balanced by controlling how the droplet is irradiated with the electromagnetic wave.

By making the hardening of the droplet on the surface and inside thereof proceed in a balanced manner, it is possible to make contraction of the droplet on the surface and the inside thereof which accompanies the hardening be uniform.

When the hardening of the droplet does not occur in a balanced manner, irregularities are formed on the surface and the surface gloss deteriorates accordingly. Controlling the irradiation of the droplet makes it is possible to realize a high surface gloss and it is possible to prevent the surface gloss from deteriorating. It is possible to realize a droplet with a high surface gloss by setting the frequency of the irradiation period to be equal to or greater than 5 Hz and less than 1000 Hz, since the length of the time period in which the hardening on the surface of the droplet is promoted, and the length of the time period in which the hardening in the inside of the droplet is promoted become an appropriate length.

In addition, the frequency setting unit may set the frequency of the irradiation period to be equal to or greater than 50 Hz, and equal to or less than 400 Hz. In this manner, it is possible to make the length of the time period in which the surface of the droplet is hardened with a bias, and the length of the time period in which the inside of the droplet is hardened with a bias can be made further preferable, and high surface gloss is realized.

Further, the frequency setting unit may set the frequency of the irradiation period to be equal to or greater than 5 Hz, and equal to or less than 50 Hz, or to be equal to or greater than 400 Hz, and less than 1000 Hz. In this manner, it is possible to make the progress of hardening the surface of the droplet and the inside thereof imbalanced, compared to a case where the frequency of the irradiation period is set to be equal to or greater than 50 Hz, and equal to or less than 400 Hz. Accordingly, it is possible to make the surface gloss of the droplet high, compared to a case where the electromagnetic wave is continuously irradiated, and to make the surface gloss low compared to a case where the frequency of the irradiation period is set to be equal to or greater than 50 Hz, and equal to or less than 400 Hz. That is, it is possible to realize a medium surface gloss of the droplet. Controlling the frequency of the irradiation period can achieve different surface glosses.

In addition, a thickness of the droplet can be controlled or selected. In one embodiment, in order to realize a high surface gloss of the droplet by setting the frequency of the irradiation period as described above, the thickness of the droplet on the recording medium may be equal to or greater than 5 μm, and equal to or smaller than 10 μm.

If the frequency of the irradiation period is less than 5 Hz, then the period of not emitting ultraviolet light is excessively long with respect to the diffusion velocity of the oxygen, and it is assumed that oxygen inhibition occurs even in the inside of the droplet. On the other hand, if the frequency of the irradiation period is equal to or greater than 1000 Hz, then the period of not emitting ultraviolet light is excessively short with respect to the diffusion velocity of the oxygen, and it is assumed that the biased hardening on the surface of the droplet may not be suppressed due to the oxygen inhibition.

Accordingly, it is possible to cause contraction biased in the depth direction of the droplet to occur by setting the frequency of the irradiation period to be less than 5 Hz, or equal to or greater than 1000 Hz. That is, it is possible to make the surface of the droplet become distorted, and to deteriorate the surface gloss of the droplet by setting the frequency of the irradiation period to be less than 5 Hz, or equal to or greater than 1000 Hz. That is, by setting the frequency of the irradiation period to be less than 5 Hz, or equal to or greater than 1000 Hz, it is possible to generate distortion on the surface of the droplet, and reduce the surface gloss.

As described above, the surface gloss of the droplet depends on the frequency of the irradiation period. Accordingly, the frequency setting unit may set the frequency of the irradiation period to be equal to or greater than 5 Hz, and less than 1000 Hz, when there was an instruction of increasing the surface gloss of a printed matter, and may set the frequency of the irradiation period to be less than 5 Hz, or equal to or greater than 1000 Hz, when there was no instruction to increase the surface gloss of the printed matter. In this manner, it is possible to make the surface gloss of the printed matter have a desired gloss.

In addition, it is possible to achieve the effect of embodiments of the invention using the electromagnetic irradiation device alone, or using other devices incorporating the electromagnetic irradiation device. For example, it may be possible to incorporate the electromagnetic irradiation device of the invention into an image forming apparatus including a droplet attachment unit which attaches the droplet to a recording medium.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1A:
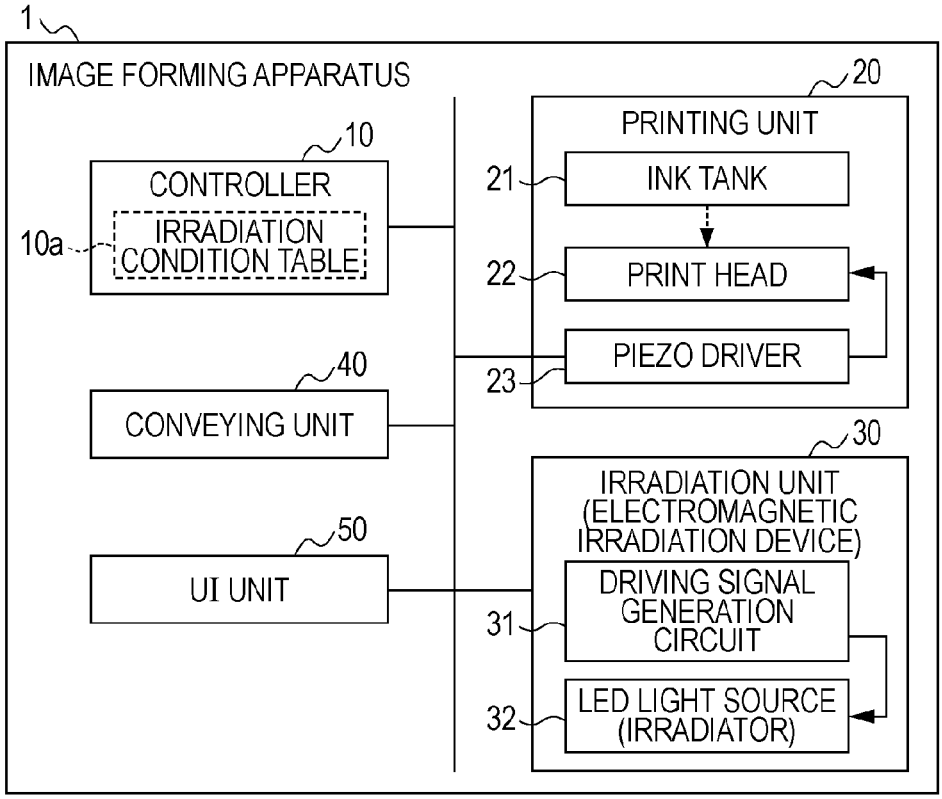
FIG. 1A is a block diagram of an embodiment of an image forming apparatus.

Hereinafter, embodiments of the invention will be described with reference to the accompanying drawings in the following order. In addition, in the drawings, the same constituent components will be denoted by the same reference numerals, and descriptions thereof will be omitted.

1. Configuration of an image forming apparatus.
2. Printing results.
3. Modified example.

1. Configuration of an Image Forming Apparatus

FIG. 1A is a block diagram of an embodiment of an image forming apparatus 1. The image forming apparatus 1 includes an electromagnetic irradiation device according to an embodiment of the invention. The image forming apparatus 1 is a line-type ink jet printer which forms printed images on a recording medium using UV curable ink. The image forming apparatus 1 includes a controller 10, a printing unit 20, an irradiation unit 30, a conveying unit 40, and a UI (User Interface) unit 50. The controller 10 may include an ASIC, a CPU, a ROM and a RAM. The ASIC and the CPU which executes a program that is recorded in the ROM execute a variety of arithmetic processing for printing control processing which will be described later. A transparent resin film is used as the recording medium in the embodiment.

The printing unit 20 includes an ink tank 21, a print head 22, and a piezo driver 23. The ink tank 21 stores ink which is supplied to the print head 22. The ink tank 21 according to the embodiment stores inks including, by of example, white ink W (white), cyan ink C (cyan), magenta ink M (magenta), yellow ink Y (yellow), black ink K (black), and clear ink CL (clear (transparent)). The ink or inks may be UV curable ink, and may include ultraviolet polymerizable resin. Polymerization proceeds through the energy of ultraviolet light as an electromagnetic wave is being received by a polymerization initiator, coloring material (other than CL), or the like. For example, the UV curable ink which is described in JP-A-2009-57548 is an example of ink stored in the ink tank 21.

Figure 1B:
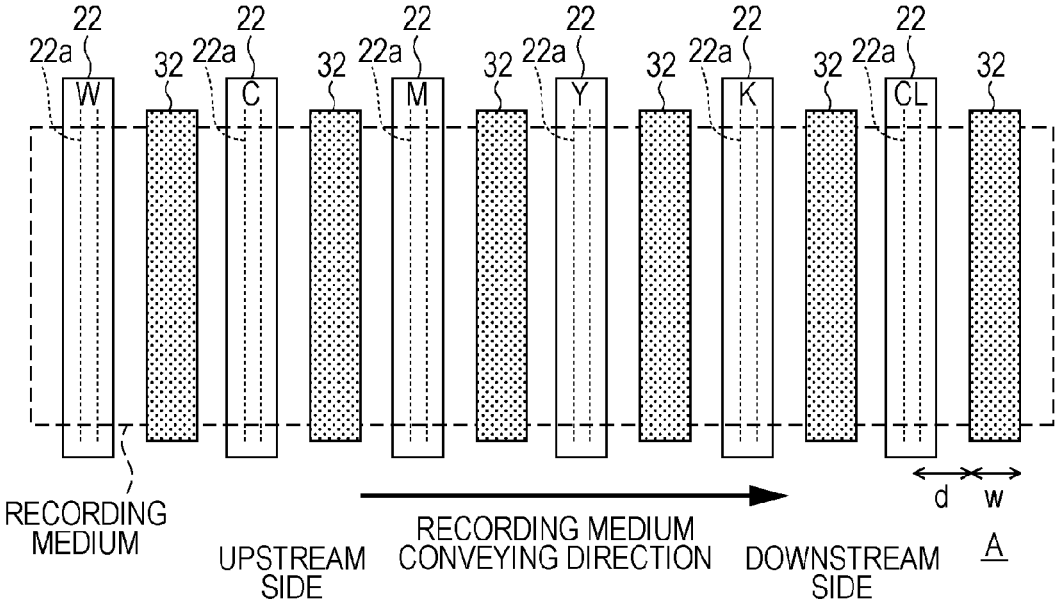
FIG. 1B is a bottom view of an embodiment of a print head.

FIG. 1B is a bottom view of the print head 22 which is seen from the recording medium side. The print heads 22 are provided for each type of ink, and are provided in order of W→C→M→Y→K→CL from the upstream side of the printing medium (dotted line) in the conveying direction in one example. The print heads 22 have nozzle surfaces which respectively face the recording medium, and includes nozzles 22*a* which are arranged in the nozzle surfaces.

In the print heads 22, the nozzles 22*a* are linearly arranged, and the arrangement direction of the nozzles 22*a* is set to or in the width direction (orthogonally to the conveying direction) of the recording medium. In addition, the nozzles 22*a* may be arranged in a range that is larger than the width of the recording medium. Each nozzle 22*a* communicates with an ink chamber, and the ink chamber is filled with ink which is supplied from the ink tank 21.

The ink chamber is provided with piezo elements for each nozzle 22*a*. The piezo driver 23 applies a driving voltage pulse to the piezo elements, on the basis of a control signal from the controller 10. The piezo elements are mechanically deformed when the driving voltage pulse is applied thereto, and pressurize or depressurize the ink in the ink chamber. In this manner, the pressurization and depressurization of the ink in the ink chamber causes an ink droplet to be ejected toward the recording medium from the nozzle 22*a*. Since the nozzles 22*a* are arranged in a range that may be larger than the width of the recording medium, it is possible to make ink droplets attach to the entire area of the recording medium in the width direction.

According to the embodiment, the ink droplet is set to be ejected with the weight c for one shot (for example, c=10 ng), so that the average thickness of the ink droplet which is formed on or attached to the recording medium is equal to or greater than 5 μm, and less than or equal to 10 μm. Furthermore, the print head 22 is equivalent to the droplet attachment unit.

The irradiation unit 30 includes a driving signal generation circuit 31, and an LED light source (irradiator) 32. In addition, the irradiation unit 30 corresponds to the electromagnetic irradiation device, and the LED light source 32 corresponds to the irradiator.

As shown in FIG. 1B, the irradiation unit 30 may be provided for each type of ink, and the LED light source 32 is provided at a position which is separated from the print head 22 by a predetermined distance d (by way of example only, d=50 mm) on the downstream side of the recording medium in the conveying direction. The LED light source 32 is formed by arranging a plurality of LED light emitting elements in the width direction of the recording medium. The LED light source 32 irradiates the entire area of the recording medium in the width direction with ultraviolet light as the electromagnetic wave almost evenly.

An irradiation range A to which the ultraviolet light is irradiated on the recording medium from the LED light source 32 has a predetermined width w (by way of example only, w=80 mm) in the conveying direction. By transporting the recording medium in the transport, it is possible to position the ink droplets which are ejected from the print heads 22 in the irradiation range A of the LED light source 32. The light source 32 is provided on the downstream side of the print head 22 and is separated from the print head by the predetermined distance d.

In this manner, the polymerization of the ink droplet which is attached onto the recording medium is started and progressed due to energy of the ultraviolet light which is irradiated from the LED light source 32. That is, the ink droplet ejected from each print head 22 is hardened by the LED light source 32 which is provided on the downstream side of each print head 22.

In other word, each print head 22 for each ink (W, C, M, Y, K, and CL) may be associated with an LED light source 32. In one embodiment, droplets ejected by the print head for white ink W are hardened by the LED light source immediately following the print head 22 for white ink in the downstream direction. Similarly, droplets of cyan ink or of other inks are hardened by the LED light source 32 immediately downstream of the corresponding print head 22.

In addition, the print heads 22 and LED lights sources 32 may be arranged such that the ink ejected by a particular print head 22 may be hardened or at least partially hardened by more than one of the LED light sources 32.

The driving signal generation circuit 31 generates a driving signal that is supplied to the LED light source 32, on the basis of a control signal from the controller 10. The driving signal generation circuit 31 is provided for each LED light source 32, and generates a different driving signal for each of the LED light sources 32 in one embodiment. Although some of the LED light sources 32 may receive the same or a similar driving signal.

Accordingly, it is possible to harden the ink droplet according to the irradiation condition of the ultraviolet light which is different for each type of ink corresponding to each print head 22. The controller 10 records or has access to an irradiation condition table 10*a* in the ROM and specifies the driving signal to be output to the driving signal generation circuit 31, by referring to the irradiation condition table 10*a*. As a result, the driving signal output by the driving signal generation circuit 31 for a corresponding ink may be different from the driving signal output by the driving signal generation circuit 31 associated with another ink.

Figures 2A, 2B:
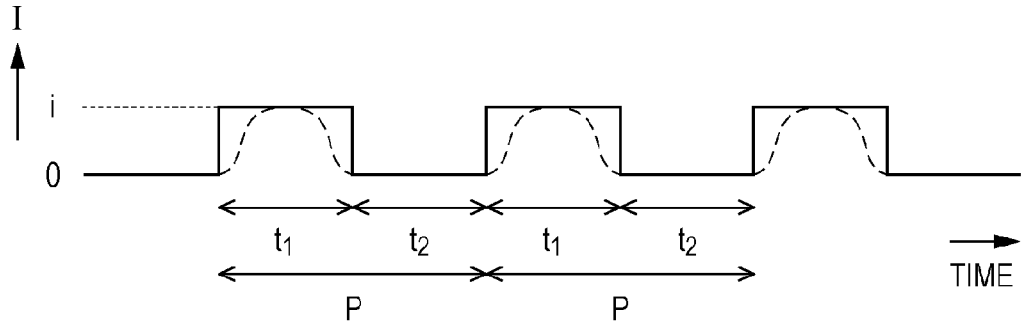
FIG. 2A is a graph which shows an embodiment of a driving signal.
FIG. 2B shows a table of example irradiation conditions.

FIG. 2A is a timing chart which shows an embodiment of a driving signal. The vertical axis in FIG. 2A denotes a current value of the driving signal, and the intensity of illumination of the LED light source 32, and the horizontal axis denotes the time. The driving signal according to the embodiment shown n FIG. 2A is a rectangular pulse current which has any one of a current value I of 0 (I=0) or a predetermined value i (a value corresponding to the intensity of illumination of approximately 0.75 W/cm$^2$ in one embodiment). The LED light source 32 emits the ultraviolet light in the irradiation period $t_1$ in which the current value I is the predetermined value i, and does not emit the ultraviolet light in the suspension period $t_2$ in which the current value is 0.

According to the embodiment, the ratio of the length of the irradiation time $t_1$ to the suspension period $t_2$ is 1 to 1, and the sum of the length of the irradiation time $t_1$ and the suspension period $t_2$ corresponds to the irradiation period P. In addition, the irradiation period P corresponds to a period in which the LED light source 32 emits the ultraviolet light in the irradiation period $t_1$. In addition, the driving signal may be a rectangular pulse current. However, as shown in FIG. 2A with dashed lines, an illumination waveform of the ultraviolet light which is emitted from the LED light source 32 in practice is a corrupted shape or may be different from the rectangular pulse current. In one embodiment, the predetermined value i is determined so that the peak intensity in the irradiation period $t_1$ becomes approximately 0.75 W/cm$^2$.

In the example irradiation condition table 10*a* which is shown in FIG. 2B, a frequency F of the irradiation period P of the driving signal is defined. The driving signal is output with respect to each of the LED light sources 32 provided for each type of ink (W, C, M, Y, K, CL). In addition, the frequency F of the irradiation period P is defined for each combination of ink whether or not a texture mode of the printed matter is used and whether or not the CL ink is used or not. Further, the printed matter means the entire printing result in which the plurality of ink droplets are overlapped with each other on the recording medium, not only the individual ink droplets. According to the embodiment, as texture modes, a gloss mode, a semi-gloss mode, and a matt mode are provided.

Referring to the W ink, the frequency F of the irradiation period P is defined as 0 Hz, regardless of the determination of whether or not the CL ink is used in any of the texture modes. In addition, when the frequency F of the irradiation period P is 0 Hz, the current value I of the driving signal always becomes the predetermined value i, and the ultraviolet light is continuously irradiated.

When it is possible to use the CL ink, the frequency F of the irradiation period P of the CL ink is defined, and when the CL ink is not used, the LED light source 32 does not emit ultraviolet light.

Referring to the CL ink, the frequency F of the irradiation period P is defined as 200 Hz, 10 Hz, and 0 Hz, respectively, when in the gloss mode, the semi-gloss mode, and the matt mode, respectively.

In addition, referring to the C, M, Y, and K inks, when the CL ink is used, the frequency F of the irradiation period P is defined as 0 Hz, regardless of the texture mode.

Referring to the C, M, Y, and K inks in a case the CL ink is not used, the frequency F of the irradiation period P is defined as 200 Hz, 10 Hz, and 0 Hz, respectively, when in the gloss mode, the semi-gloss mode, and the matt mode, respectively.

When the combination of the texture mode of the printed matter and the determination of whether or not the CL ink is used is obtained, the controller 10 specifies the frequency F of the irradiation period P which corresponds to the combination in the irradiation condition table 10*a* for each type of the ink.

In addition, the controller 10 outputs a control signal which causes the driving signal of the frequency F of the irradiation period P to be generated, which was specified for each type of the ink to the driving signal generation circuit 31 which corresponds to each type of the ink. In this manner, the driving signal generation circuit 31 which corresponds to each type of the ink generates the driving signal, and outputs the driving signal to the corresponding LED light source 32.

In addition, the combination of the texture mode of the printed matter and the determination of whether or not the CL ink is used is not changed in the printing of a single printing work, and the frequency F of the irradiation period P is not changed in a printing period of the single printing work.

Further, the driving signal generation circuit 31 includes a DC power supply circuit which supplies a DC current of which the current value I is the predetermined value i, an oscillator circuit with a variable period which generates a pulse wave of each frequency F, and a switching circuit which switches the DC current on the basis of the pulse wave. The controller 10 corresponds to the irradiation control unit and the frequency setting unit. In addition, it is possible to easily control the periodic irradiation of the ultraviolet light using the current pulse, by using the LED light source 32 which may be a solid-state light emitting element.

The conveying unit 40 includes a conveying motor, a conveying roller, motor driver, and the like. The recording medium is conveyed in the conveying direction on the basis of the control signal from the controller 10. In this manner, it is possible to land an ink droplet at each position on the recording medium in the conveying direction and in the width direction, and it is possible to form a two dimensional image. The ink droplets can be ejected from the print heads to form the two dimensional image. In addition, it is possible to move each position of the recording medium to be immediately below the print head 22 which corresponds to each type of the ink in order, and to make the ink droplet attach to the recording medium in an overlapping manner, in an order of W→C→M→Y→K→CL from below in one example. That is, the W ink droplet including a white coloring material is firstly attached to the recording medium, thereafter, the ink droplets of C, M, Y, K are subsequently attached to the recording medium. Finally, the transparent CL ink droplet is attached to the recording medium.

In addition, ink droplets of each type of the ink are attached to the recording medium before the recording medium moves to an irradiation range A of a LED light source 32 which corresponds to the type of the ink which just been attached to the recording medium. The ink droplet is hardened by the ultraviolet light from the corresponding LED light source 32. In addition, while moving in the irradiation range A, the ink is hardened. The ink may be hardened in a balanced manner as discussed herein in order to achieve a particular gloss.

Thereafter, the subsequent type of ink droplet is attached in an overlapping manner by conveying the recording medium further. That is, the ink droplet of each type of the ink is irradiated with the ultraviolet light respectively, by the LED light source 32 which corresponds to the type of the ink. It follows that the ink droplet which has attached to the recording medium in advance is also irradiated with the ultraviolet light from the LED light source 32 which corresponds to the type of the ink of the ink droplet which is attached to the recording medium later. However, since the ink droplet which has attached to the recording medium in advance is already hardened to some extent, the influence of the LED light source 32, which corresponds to the type of the ink of the ink droplet which attaches to the recording medium later, on the surface gloss of the ink droplet which has attached to the recording medium in advance can be ignored. For example, the LED light sources 32 corresponding to the C, M, Y, K, and CL inks may irradiate the W ink. However, the influence of the LED light sources 32 corresponding to the C, M, Y, K, and CL inks may be ignored since the LED light source 32 corresponding to the W ink already irradiated the W ink before the LED light sources corresponding to the other inks.

In addition, since the W ink droplet is formed on the lowest layer (closest to the recording medium side), it is possible to form a ground with a flat spectral reflection characteristic, similarly to a white recording medium, even if it is not the white recording medium. It is possible to reproduce various colors by overlapping the ink droplet with each other on the ground, which includes each of the coloring materials of C, M, Y, and K which have, respectively, different spectral reflection characteristics. In addition, when the CL ink droplet is overlapped therewith, it is possible to adjust the texture of the surface of the printed matter due to the ink droplets of CL. According to the embodiment, the conveying velocity of the recording medium at the time of constant-speed printing is $v_1$ to $v_2$ (for example, $v_1$=200 mm/second, $v_2$=1000 mm/second). The length of a period from attaching of the ink droplet to the recording medium to moving the attached ink droplet into the irradiation range A of the LED light source 32 is set to $d/v_2$ to $d/v_1$ seconds (d is a distance of the print head to the LED light source). In addition, the length of time during when the ink droplet is irradiated with the ultraviolet light in the irradiation range A is set to $w/v_2$ to $w/v_1$ seconds (w is a width of the irradiation range A or of the LED light source).

The UI unit 50 includes a display unit which displays images, and an operation unit which receives operations. The UI unit 50 displays a selection instruction of the texture mode of the printed matter, and a printing condition setting image for receiving the determination of whether or not to use the CL ink on the display unit, on the display unit on the basis of the control signal from the controller 10. In addition, the UI unit 50 receives the selection instruction of the texture mode and the determination of whether or not to use the CL for each printing work using the operation unit, and outputs an operation signal which shows the combination thereof to the controller 10. The combination of texture mode and whether the CL ink is used can thus be received with the UI unit 50.

Accordingly, the controller 10 obtains the combination of the texture mode of the printing matter and the determination of whether or not to use the CL ink for each printing job. The controller 10 may also specify the frequency F of the irradiation period P which corresponds to the combination.

Subsequently, a printing result of the printed matter will be described, which is printed on the recording medium using the image forming apparatus 1 which has been described above.

2. Printing Result

Figure 3A:
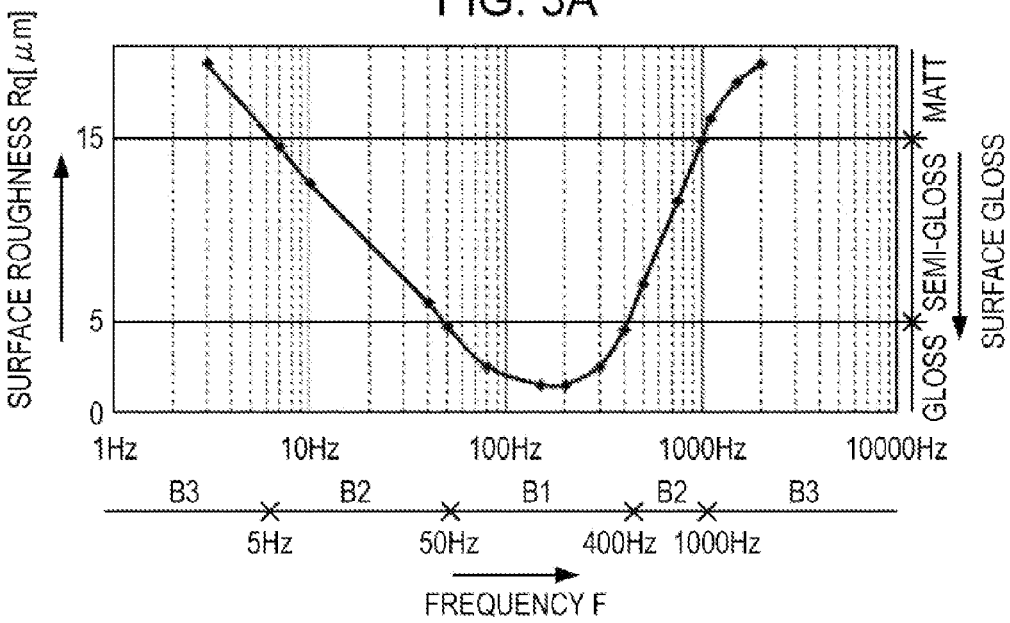
FIG. 3A is a graph which shows surface roughness.

FIG. 3A is a graph which shows the surface roughness (surface gloss), and FIGS. 3B to 3G are schematic diagrams which show the printed matter. The vertical axis in FIG. 3A denotes the surface roughness Rq, and the horizontal axis denotes the frequency F of the irradiation period P (a logarithm). The surface roughness Rq is measured according to the following order. First, an ink droplet of the weight c is attached to the recording medium, and the ink droplet is hardened by the ultraviolet light of the frequency F, thereby forming a measurement sample. In addition, according to the embodiment, the measurement sample is to be formed using a CL ink droplet which is formed on the uppermost surface side, and has the highest level of contribution with respect to the surface gloss. Further, the surface height h (x) in each position x of the measurement sample is measured over a section of the length l (x=0 to 1), for example, using an optical method such as a focal depth method, or the like. In addition, the length l may be sufficiently smaller than the size of the ink droplet in the direction parallel to the recording medium so that the height h (x) does not influence the curved shape of the ink droplet itself. Further, the height h (x) may be obtained by measuring the displacement of the probe which comes into contact with the surface of the measurement sample. Subsequently, it is possible to obtain the surface roughness Rq by substituting the height h (x) to the expression (1) as set forth below.

$$Rq = \sqrt{\frac{1}{1}\int_0^1 f(x)^2 dx} \tag{1}$$

-continued $$f(x) = h(x) - \frac{1}{1}\int_0^1 h(x)dx$$

As shown in the expression (1), the surface roughness Rq corresponds to root mean square of the deviation f(x) with respect to the mean value of the height h (x). Here, the smaller the surface roughness Rq, the closer the surface of the measurement sample becomes to a mirror surface, and the smaller the surface roughness Rq, the higher the surface gloss.

As shown in FIG. 3A, when the frequency F of the irradiation period P is 150 Hz to 200 Hz, the surface roughness Rq approaches the minimum value (approximately 1.5 μm), and the surface gloss of the measurement sample approaches the maximum value corresponding to the highest gloss. When the frequency F of the irradiation period P belongs to the gloss band B1 of equal to or greater than 50 Hz, and less than 400 Hz, the surface roughness Rq becomes less than a first threshold value (5 μm), and the surface gloss of the measurement sample becomes higher than the surface gloss which corresponds to the first threshold value of the surface roughness Rq. In addition, when the frequency F of the irradiation period P belongs to a semi-gloss band B2 which is equal to or greater than 5 Hz, and less than 50 Hz, or equal to or greater than 400 Hz, and less than 1000 Hz, the surface roughness Rq becomes equal to or greater than the first threshold value, and less than the second threshold value (approximately 15 μm). In addition, the surface gloss of the measurement sample is higher than that of the surface gloss which corresponds to the second threshold value of the surface roughness Rq, however, the surface gloss of the measurement sample is set to be equal to or smaller than the surface gloss which corresponds to the first threshold value. On the other hand, when the frequency F of the irradiation period P belongs to a matt band B3 which is less than 5 Hz, or equal to or greater than 1000 Hz, the surface roughness Rq becomes equal to or greater than the second threshold value, and the surface gloss of the measurement sample is set to be equal to or smaller than the surface gloss which corresponds to the second threshold value of the surface roughness Rq.

Figure 4:
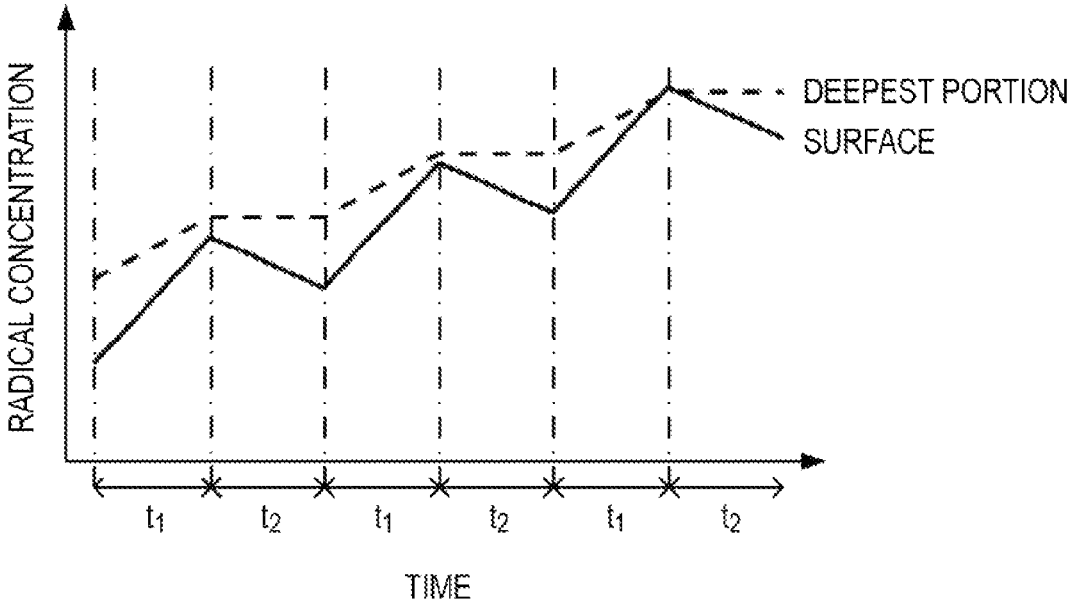
FIG. 4 is a graph which shows radical concentration.

FIG. 4 is a graph which shows a radical concentration in the ink droplet. Here, the radical concentrations in the surface and the deepest portion of the ink droplet are modeled under the following conditions. First, in the irradiation period $t_1$ (FIG. 2A) during which the ultraviolet light is irradiated, the radical concentration at the deepest portion increases only by 50% of an increment of the radical concentration on the surface per unit time. This is because the ultraviolet light is attenuated as it proceeds in the depth direction of the ink droplet. Accordingly, the energy of the ultraviolet light that is necessary for the generation of the radical concentration is applied with a bias onto the surface. In addition, this is because the radical chain which is generated in the vicinity of the surface has a high probability of stopping in the vicinity of the surface, and it is not easy for the radical concentration to increase in the deepest portion of the ink droplet. On the other hand, in the stop period $t_2$ (FIG. 2A) during which the ultraviolet light is not irradiated, the radical concentration on the surface decreases only by 40% of an increment of the radical concentration in the irradiation period $t_1$ during which the ultraviolet light is irradiated per unit time. In addition, the oxygen is not diffused to the deepest portion of the ink droplet, accordingly, the radical concentration in the deepest portion is not influenced by the oxygen inhibition, in any of the irradiation period $t_1$ and the stop period $t_2$.

As shown in FIG. 4, since the increment of the radical concentration on the surface in the irradiation period $t_1$ becomes large with respect to the deepest portion, the radical concentration on the surface becomes larger than that of the deepest portion. On the other hand, since the radical concentration in the stop period $t_2$ decreases because the radical concentration is influenced by the oxygen inhibition only on the surface, the difference in the radical concentration which is generated in the irradiation period $t_1$ is suppressed in the stop period $t_2$.

Accordingly, by causing the irradiation period $t_1$ and the stop period $t_2$ to be repeated, it is possible to suppress the difference in the radical concentration on the surface and in the deepest portion, and to increase the radical concentration. That is, it is possible to make the hardening of the ink droplet proceed on the surface and in the deepest portion in a balanced manner, and to make the contraction of the ink droplet which accompanies the hardening of the ink droplet on the surface and in the deepest portion be uniform or more uniform.

Accordingly, it is possible to prevent the surface gloss from deteriorating by suppressing the generation of irregularities on the surface due to the distortion of the ink droplet. Accordingly, it is possible to realize a high surface gloss. The smaller the difference between the radical concentration in the surface and the radical concentration in the deepest portion of the ink droplet, the higher the surface gloss. In other words, a higher surface gloss may be achieved by keeping the difference between the radical concentration in the surface and the radical concentration in the deepest portion of the ink droplet small.

In addition, as shown in FIG. 3A, the surface gloss of the ink droplet depends on the frequency F of the irradiation period P during which each irradiation period $t_1$ is started. It is assumed that this is because a relative balance among the length of the irradiation period P (the irradiation period $t_1$ and the stop period $t_2$), a reaction velocity of the reaction of the radical polymerization, and a diffusion velocity of the oxygen in the ink droplet is changed, when the frequency F is changed.

As shown in FIG. 3A, when the frequency F of the irradiation period P belongs to the matt band B3, the model shown in FIG. 4 is not established. When the frequency F of the irradiation period P is less than 5 Hz which belongs to the matt band B3, it is assumed that the stop period $t_2$ becomes excessively long with respect to the diffusion velocity of the oxygen, and the oxygen inhibition occurs in the deepest portion of the ink droplet. In this case, there is a high probability that the whole ink droplet is not hardened. On the other hand, when the frequency F of radiation period P is equal to or greater than 1000 Hz which belongs to the matt band B3, it is assumed that the stop period $t_2$ becomes excessively short with respect to the diffusion velocity of the oxygen, and it is difficult to suppress the biased hardening on the surface due to the oxygen inhibition. In addition, even when the thickness of the ink droplet in the measurement sample is changed from 5 to 10 μm, and when the type of the ink which is used when forming the measurement sample is changed, it is possible to obtain approximately the same surface roughness Rq as that shown in FIG. 3A.

Figure 3B:
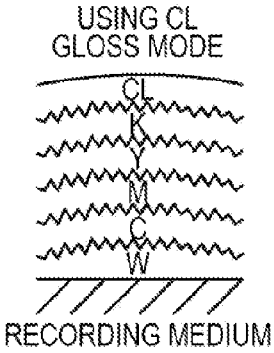
FIGS. 3B to 3G are schematic diagrams which show printed matters.
Figure 3D:
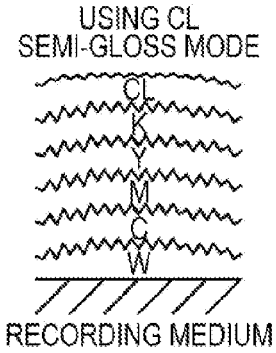
Figure 3F:
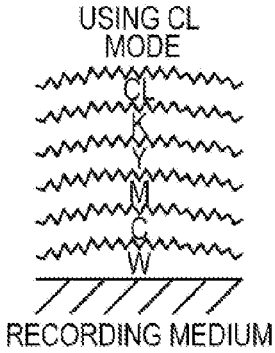
Figure 3C:
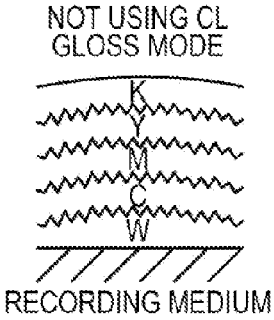
Figure 3E:
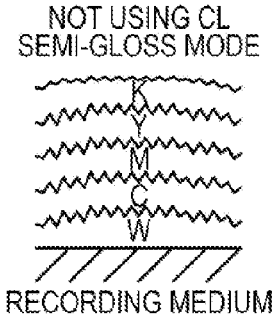
Figure 3G:
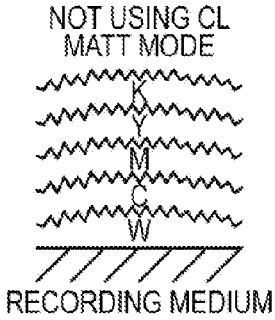

FIGS. 3B to 3G are schematic diagrams which show the printed matter (perpendicular cross-section of recording medium (hatched)) for each combination of the texture mode and whether or not the CL ink is used. FIGS. 3B, 3D, and 3F show the printed matter when the CL is used, and FIGS. 3C, 3E, and 3G show the printed matter when the CL ink is not used. In addition, FIGS. 3B and 3C show printed matters in which the texture mode is the gloss mode, FIGS. 3D and 3E show printed matters in which the texture mode is the semi-gloss mode, and FIGS. 3F and 3G show printed matters in which the texture mode is the matt mode.

In the irradiation condition table 10*a* in FIG. 2B, the frequency F of the irradiation period P with respect to the W ink is set to 0 Hz which belongs to the matt band B3, regardless of the texture mode and whether or not the CL ink is used, and the surface gloss of the W ink droplet is set to be low. In this manner, it is possible to increase the sense of white by promoting the diffused reflection on the surface. In addition, as shown in FIGS. 3B to 3G, considering that other types of ink droplets are overlapped with and bonded to the W ink droplet, the surface gloss of the W ink droplet is set to be low. As the surface gloss of the ink droplet (of one or more inks) is low, that is, as the surface roughness Rq is large, the bonded area among the ink droplets which overlap with each other in the thickness direction is increased. Accordingly, it is possible to obtain a high bonding strength. In addition, since the W ink droplet is formed on the recording medium side which is farthest from the surface, and of which the level of contribution to the surface texture is low, it is possible to set the surface gloss of the W ink droplet to be low, regardless of the texture mode.

On the other hand, when the CL ink is used, as shown in FIGS. 3B, 3D, and 3F, since the CL ink droplet is formed on the uppermost surface, the level of contribution of the CL ink with respect to the texture of the printed matter is the highest. Accordingly, in the irradiation condition table 10*a* in FIG. 2B, when the texture mode is the gloss mode, the frequency F of the irradiation period P of the CL ink is set to 200 Hz, which belongs to the gloss band B1. In addition, when the texture mode is the semi-gloss mode, the frequency F of the irradiation period P of the CL ink is set to 10 Hz, which belongs to the semi-gloss band B2. When the texture mode is the matt mode, the frequency F of the irradiation period P of the CL is set to 0 Hz, which belongs to the matt band B3. In this manner, when the CL ink is used, it is possible to obtain the printed matter with the surface gloss that is desired by a user. In addition, when the CL ink is used, the frequencies F of the irradiation periods P of the W, C, M, Y, and K are set to 0 Hz which belongs to the matt band B3 in order to improve the junction strength with the upper ink droplet. When the CL ink is used, since the influence on the texture of the surface of the ink droplets of W, C, M, Y, and K is small, it is possible to concentrate on the junction strengths of these droplets.

On the contrary, when the CL is not used, the influence of the ink droplets of C, M, Y, and K on the texture on the surface is large, as shown in FIGS. 3C, 3E, and 3G. Accordingly, in the irradiation condition table 10*a* in FIG. 2B, when the CL ink is not used, a value which corresponds to the texture mode as the frequency F of the irradiation period P with respect to the C, M, Y, and K is defined. That is, when the texture mode is the gloss mode, the frequency F of the irradiation period P with respect to the C, M, Y, and K is set to 200 Hz which belongs to the gloss band B1. In addition, when the texture mode is the semi-gloss mode, the frequency F of the irradiation period P with respect to the C, M, Y, and K is set to 10 Hz which belongs to the semi-gloss band B2. When the texture mode is the matt mode, the frequency F of the irradiation period P with respect to the C, M, Y, and K is set to 0 Hz which belongs to the matt band B3.

As described above, it is possible to obtain high surface gloss of the ink droplet compared to a case where the ultraviolet light is continuously irradiated, by setting the frequency F of the irradiation period P to a value which belongs to the gloss band B1 or the semi-gloss band B2. In addition, it is possible to obtain a printed matter with a desired surface gloss by switching the frequency F of the irradiation period P according to a texture mode which is selected and instructed. Further, it is possible to realize a surface gloss (surface roughness) of the ink droplet that is suitable for the function of the ink and the attaching order of the ink droplet, by setting the frequency F of the irradiation period P according to the type of the ink.

3. Modified Example

In the above described embodiment, the frequency F of the irradiation period P was set according to the type of the ink. However, the frequency F of the irradiation period P which belongs to the gloss band B1, or the semi-gloss band B2 may be set uniformly with respect to every type of ink or with respect to more than one ink. Even in this case, it is possible to realize high surface gloss compared to a case where the ultraviolet light is continuously irradiated.

It follows that the frequency F of the irradiation period P which belongs to the gloss band B1, or the semi-gloss band B2 may be set, and a frequency other than the frequency F which is defined in the irradiation condition table 10*a* according to the above described embodiment may be set. That is, when it is a type of ink of which the droplet is attached later among the ink of C, M, Y, and K, the frequency F of the irradiation period P may be set so that the surface gloss of the ink droplet is increased. In addition, when a recording density of the ink droplet which is attached later is small, the probability of overlapping the ink droplet with each other in the thickness direction, as shown in FIGS. 3B to 3G is low. Accordingly, when image data to be printed specifies a light ink color, the frequency F of the irradiation period P may be set to a frequency F that realizes the high surface gloss. This is also the case for the type of ink of which the droplet is ejected earlier.

In addition, embodiments of the invention may be applied to a serial printer in which the ink droplet is ejected while moving a carriage (ink head), which is perpendicular to the conveying direction of the recording medium, in the main scanning direction. Further, in this case, the irradiator may be provided in the carriage, or may be provided separately from the carriage. It follows that it is possible to obtain a monochrome printing image with a high surface gloss by setting the frequency F of the irradiation period P in an image forming apparatus which uses a single color of ink, without being limited to the image forming apparatus which uses a plurality of types of ink. In addition, according to the above described embodiments, the frequency F of the irradiation period P of the ultraviolet light was set, however, it is possible to set the frequency F of the irradiation period P of other electromagnetic waves such as visible light, microwaves, or the like. In this manner, it is possible to obtain a printed matter with high surface gloss using an ink droplet which is hardened using other electromagnetic waves. It follows that electromagnetic wave sources are not limited to LEDs, and may be rare gas light sources, or the like.

What is claimed is:

1. An electromagnetic irradiation device comprising:

an irradiator which irradiates droplets which are attached to a recording medium with an electromagnetic wave;

an irradiation control unit which causes the irradiator to irradiate the droplets with the electromagnetic wave periodically; and a frequency setting unit which sets a frequency of an irradiation period which is a period during which the irradiator is caused to emit the electromagnetic wave to be equal to or greater than 5 Hz, and less than 1000 Hz.

2. The electromagnetic irradiation device according to claim 1, wherein the frequency setting unit sets the frequency of the irradiation period to be equal to or greater than 50 Hz, and less than 400 Hz.

3. An image forming apparatus comprising:

the electromagnetic irradiation device according to claim 2; and a droplet attachment unit which attaches the droplet to the recording medium.

4. The electromagnetic irradiation device according to claim 1, wherein the frequency setting unit sets the frequency of the irradiation period to be equal to or greater than 5 Hz, and less than 50 Hz, or to be equal to or greater than 400 Hz, and less than 1000 Hz.

5. An image forming apparatus comprising:

the electromagnetic irradiation device according to claim 4; and a droplet attachment unit which attaches the droplet to the recording medium.

6. The electromagnetic irradiation device according to claim 1, wherein when a thickness of the droplet on the recording medium is equal to or greater than 5 μm, and equal to or less than 10 μm, the frequency setting unit sets the frequency of the irradiation period to be equal to or greater than 5 Hz, and less than 1000 Hz.

7. An image forming apparatus comprising:

the electromagnetic irradiation device according to claim 6; and a droplet attachment unit which attaches the droplet to the recording medium.

8. An image forming apparatus comprising:

the electromagnetic irradiation device according to claim 1; and a droplet attachment unit which attaches the droplet to the recording medium.

9. An electromagnetic irradiation device comprising:

an irradiator which irradiates droplets which are attached to a recording medium with an electromagnetic wave;

an irradiation control unit which causes the irradiator to irradiate with the electromagnetic wave periodically; and a frequency setting unit which sets a frequency of an irradiation period which is a period during which the irradiator is caused to emit the electromagnetic wave to be less than 5 Hz, or equal to or greater than 1000 Hz, when there was an instruction of decreasing a surface gloss of a printed matter.

10. An image forming apparatus comprising:

the electromagnetic irradiation device according to claim 9; and a droplet attachment unit which attaches the droplet to the recording medium.

11. An electromagnetic irradiation device comprising:

a plurality of irradiators which irradiate droplets which are attached to a recording medium with an electromagnetic wave, wherein the droplets are attached by a plurality of print heads and each print head is associated with one of the irradiators and with a different curable ink;

an irradiation control unit which causes the plurality of irradiators to irradiate the droplets with the electromagnetic wave periodically, wherein each of the irradiators is configured to irradiate a corresponding curable ink; and a frequency setting unit which sets a frequency of an irradiation period for each of the irradiators, wherein the irradiation period for each irradiator is a period during which the irradiator is caused to emit the electromagnetic wave, the frequency of the irradiation period being equal to or greater than 5 Hz and less than 1000 Hz.

12. The electromagnetic irradiation device of claim 11, wherein the irradiation period for at least some of the irradiators includes a first period $t_1$ and a suspension period $t_2$, wherein a current is 0 during the suspension period.

13. The electromagnetic irradiation device of claim 12, wherein, for at least one of the irradiators, the first period and the second period are set so as to balance a hardening of a corresponding droplet of curable ink.

14. The electromagnetic irradiation device of claim 11, wherein the frequency of the irradiation period for at least one of the irradiators is set so as to cause one of a high gloss, a semi-gloss, or a matt in the droplet.

* * * * *